United States Patent [19]

Newman

[11] 4,120,401

[45] Oct. 17, 1978

[54] FINGER RING DISPLAY

[75] Inventor: Thomas A. Newman, Cranston, R.I.

[73] Assignee: McGrath-Hamin, Inc., Providence, R.I.

[21] Appl. No.: 845,414

[22] Filed: Oct. 25, 1977

[51] Int. Cl.[2] ..... B65D 1/34

[52] U.S. Cl. ..... 206/566; 211/13

[58] Field of Search ..... 206/45.14, 523, 559–560, 206/564–566; 211/4, 13, 69.1–69.9, 163; 312/117

[56] References Cited

U.S. PATENT DOCUMENTS

| | | | |
|---|---|---|---|
| 549,970 | 11/1895 | Lawrence | 206/566 X |
| 1,063,662 | 6/1913 | Dahl | 206/566 X |
| 1,114,998 | 10/1914 | Love | 206/566 X |
| 1,956,205 | 4/1934 | Scruggs | 206/566 X |
| 1,994,363 | 3/1935 | Kettendorf | 206/566 X |
| 2,321,339 | 6/1943 | Wadsworth | 206/566 X |
| 3,289,853 | 12/1966 | Eichhorn et al. | 211/13 |

FOREIGN PATENT DOCUMENTS

| | | | |
|---|---|---|---|
| 216,117 | 11/1909 | Fed. Rep. of Germany | 211/69.6 |
| 392,846 | 3/1924 | Fed. Rep. of Germany | 206/566 |
| 1,270,424 | 7/1961 | France | 206/566 |

*Primary Examiner*—Steven E. Lipman
*Attorney, Agent, or Firm*—Salter & Michaelson

[57] ABSTRACT

A jewelry display for rings which enables prospective customers to try on the rings and which prevents ring theft. The device includes a frame having a member in turn having a front display face through which a plurality of slots are provided so as to receive the shank portions of the finger rings while the ornamental portion thereof is outwardly displayed from the front surface. A reel having a spring retractable line attached thereto is disposed behind each of the slots. The line is connected to the ring so that it may be drawn away from the display surface as when a prospective customer is trying on a ring for size or style and so as to require return of the ring to its respective slot when released.

7 Claims, 5 Drawing Figures

FINGER RING DISPLAY

BACKGROUND OF THE INVENTION

This invention relates to a display device for displaying articles of jewelry, particularly finger rings. Such rings include a shank portion for receipt by the wearer's finger and an ornamental portion connected thereto. The particular form which the ornamental portion may take is extremely varied, especially in popular priced jewelry. It is accordingly desirable that when such jewelry is displayed that it is done in such a manner which permits prospective customers to try on one or more of the rings so as to determine its effect or appropriateness prior to selecting one for purchase.

Display cases or other devices for holding rings such that the prospective customer may select and trial wear such articles are well-known and normally include a decorative surface on which the rings are openly mounted as in spring action clips, or provided with slots for frictional receipt of the shank portion. In such prior art systems where the rings are freely accessible to prospective purchasers, there is the possibility or likelihood that theft may occur and for this reason such displays require to some extent the constant attention of sales personnel. Such attention is not only time-consuming and expensive, but also on some occasions unwelcomed by the prospective customer. Accordingly, the need exists for a display device which provides for free trial wearing access to prospective customers yet which minimizes or eliminates the possibility of pilferage.

SUMMARY OF THE INVENTION

It is accordingly an object of the present invention to provide a jewelry display especially adapted for finger rings which enables a plurality of such rings to be simultaneously displayed and which further permits a prospective customer to trial wear such rings yet eliminates the potential for the theft thereof.

A still further object of the present invention is the provision of a display device of the type immediately aforementioned wherein the rings may be easily grasped and manipulated for trial wearing by prospective customers but which nevertheless insures the replacement of the ring in its proper display position thereafter.

These and other objects of the present invention are accomplished by tethering each of the rings associated with the display to the retractable line of a spring actuated reel. Each of the reels is mounted behind and in alignment with a relatively narrow slot provided in a display member and adapted to receive the shank portion of the finger ring. In this way, the rings may be easily trial worn by the prospective purchaser and yet the purchaser may not either inadvertently or purposely remove the ring entirely from the display, and further enables the ring to be automatically retracted to a position in close proximity to the display for remounting therein.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
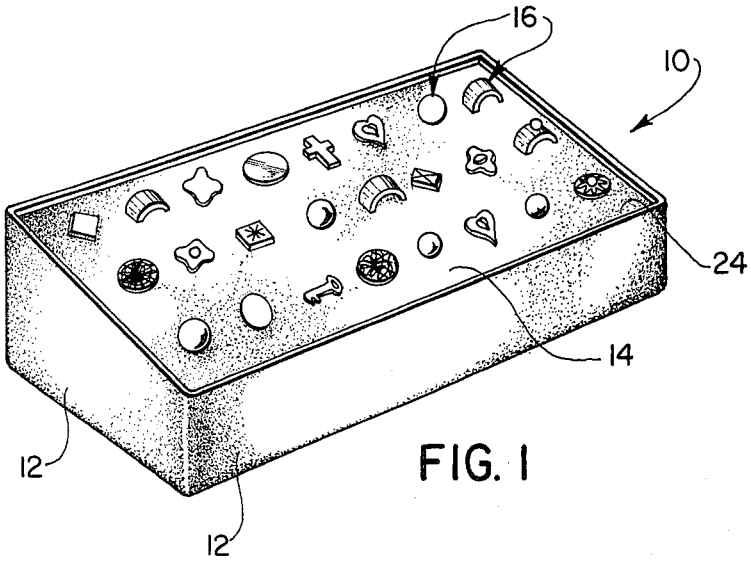
FIG. 1 is a perspective view of the device of the present invention showing a plurality of finger rings each having a different ornamentation displayed therein.
Figure 5:
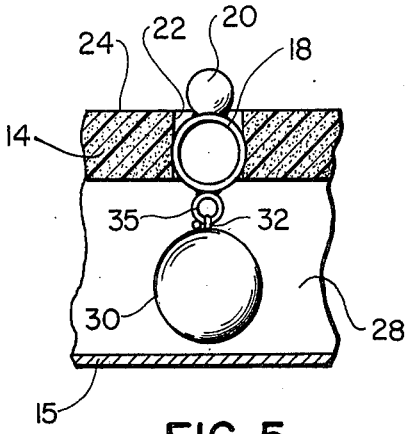
FIG. 5 is a sectional view taken along the line 5—5 of FIG. 3.
Figure 2:
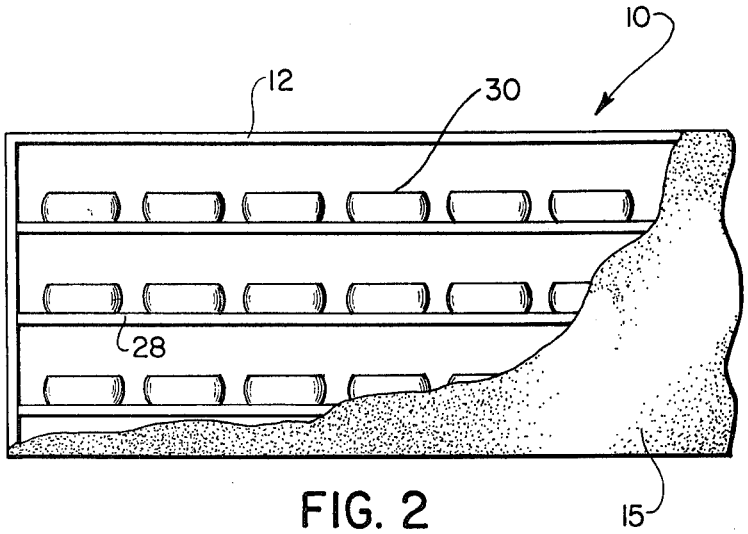
FIG. 2 is a bottom view thereof with parts broken away for clarity.
Figure 3:
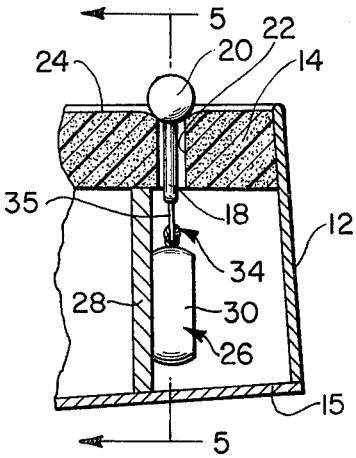
FIG. 3 is a side sectional view of a portion of FIG. 1 showing a finger ring in its retracted display position.

Turning now to the drawing and particularly FIGS. 1 and 2 thereof, the jewelry display device 10 of the present invention takes the form of a container or case having a frame 12 suitably decorated as by a cloth covering and the like. The frame 12 in turn supports a display member 14 having considerable thickness and preferably formed of an easily depressible material such as polymeric sponge or foam andinto which a plurality of finger rings 16 may be inserted in a manner that will hereinafter be set forth such that the ornamental portions thereof are easily visible to a prospective customer. The member 14 is also suitably decorated by coloration, texture and the like to the extent appropriate for the particular type finger rings being sold. The bottom of the case or device 10 may be provided with a bottom wall 15 so that the case is essentially totally enclosed.

The rings 16 include a shank portion 18 adapted to engage the wearer's fingers and an ornamental portion 20 which is generally substantially larger in lateral extent than that of the shank portion 18. The display member 14 is provided with a plurality of relatively narrow slots 22 longitudinally extending a distance sufficient to accommodate the diametric dimension of the ring shank 18. The slots 22 extend entirely through the member 14 and accordingly present openings on the front or display face 24 thereof. In essence then, the prospective customer viewing the display device 10 primarily sees the various ornamental portions 20 of the plurality of finger rings 16, the shank portions being hidden within the slots 22, within which they are frictionally maintained.

Behind each slot 22, there is provided tether means 26, suitably positioned as by mounting on one of the ribs 28 which longitudinally extend opposite wall portions of the frame 12. The tether means 26 includes a conventional spring loaded reel 30 in which a line 32 is disposed so as to be outwardly extensible therefrom and spring retracted thereinto. The free end of the line 32 is in turn attached to connecting means 34 which may take the form of a secondary and smaller ring 35 which additionally acts as a spacing element. The ring 35 may be connected to line 32 by a conventional knot 36 or by any other suitable connecting means. The other end of the spacer or ring 35 is attached to the outside surface of the shank portion 18 as by soldering, brazing or the like in such a manner so as to not interfere with the inner surface of the shank portion 18 which must be free and unencumbered so as to comfortably receive the prospective customer's finger. The spacer or ring 35 may be of a height or vertical extent such the combined height of both it and the shank portion 18 determines the spacing between the front surface 24 and the upper portion of the reel 30 from which the line 32 extends such that the ornament 20 is displayed adjacent such front surface 24. Alternatively, those portions of the display member 14 adjacent the slot 22 can be utilized to support and retain the ornament 20 above such member and in contact with the front display surface 24 thereof. In such alternative cases, the spring tension of the reel 30 would necessarily be such so not as to unduly draw the ornament into the slot 22, as well as insufficient to unduly compress the resilient surface 24.

Figure 4:
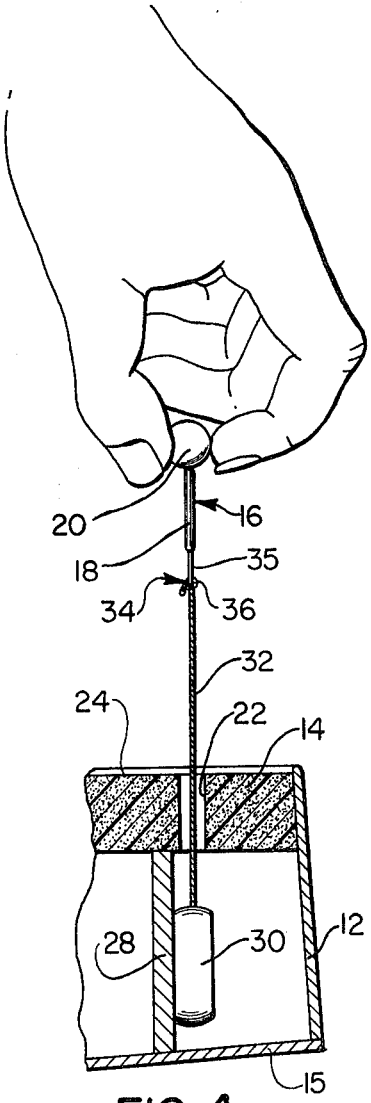
FIG. 4 is a view similar to FIG. 3 but showing the ring in its withdrawn position preliminary to being trial worn by a prospective customer.

Operation of the device 10 is accomplished in the following manner: a prospective customer observing the display selects one of the finger rings 16 for trial wearing. The customer then merely grasps, as shown in FIG. 4, the ornamental portion of the particular ring 16 selected (the resilient nature of the material from which the display member 14 is formed permits one's fingers to move beneath the ornament for access in grasping such) and thereafter simply pulls the ring away from the display sufficient for it to be conveniently slipped on his or her finger. The tension exterted on the line 32 by the spring means within the reel 30 is such so as to not unduly restrain such activity. Thereafter the customer simply releases the ring and the spring force of the reel 30 draws the finger ring back toward the display for re-insertion into its slot 22. This assures that each ring, after inspection and trial wear, will automatically return to a position adjacent the display case 10. Also, because each of the rings 16 is tethered to a reel 30, the rings cannot be purposely or inadvertently removed from the display and accordingly reduces or eliminates attempted pilferage.

The display of the present invention may additionally be utilized in conjunction with an overall rack or case which houses an inventory of the rings displayed so that once a customer has selected a particular ring for purchase, such ring may be easily supplied from the rack or case by a salesperson. In any event, the device of the present invention enables the salesperson to service a greater number of customers or potential customers simultaneously and with a reduced risk of merchandise theft, since even though the line 32 could be surreptitiously cut or broken, the permanent attachment of ring 35 to shank 18 minimizes the likelihood of theft of the display rings.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry display for finger rings having enlarged ornamental portions and the like, comprising a frame for supporting a display member in turn having a generally planar display surface, said member having a plurality of relatively narrow slots formed entirely therethrough and opening on said display surface, said slots being large enough to permit the frictional receipt of the shank portion of said finger rings, but not large enough for said ornamental portion to pass therethrough, whereby such ornament is retained on said display surface of said display member, a plurality of finger rings disposed within said slots, automatically retractable tether means supported by said frame and positioned behind said slots, and means for connecting the shank portions of each said finger ring to its respective tether means such that each of said finger rings may be grasped and pulled away from said front surface for trial fitting and thereafter automatically retracted to a position adjacent said display surface, said connecting means being characterized in that engagement is made solely with the outer surface of said shank portion, thereby leaving the inner surface of said shank portion completely free and unencumbered.

2. The jewelry display of claim 1, said tether means being a spring operated reel positioned behind each slot, each reel having a spring actuated extensible and retractable line, the free end of said line connected to said connecting means.

3. The jewelry display of claim 2, said connecting means comprising a spacer element connected at one of its ends to the outside surface of said shank portion generally opposite to the position of said ornament, and to said line at its other end.

4. The jewelry display of claim 3, said spacer element being a secondary ring member.

5. The jewelry display of claim 3, said each of said reels positioned in back of said display surface a distance generally equal to the combined length of said ring portion and said spacer element.

6. The jewelry display of claim 3, wherein said display member is formed of an easily compressible material so that a prospective customer may easily grasp each finger ring from behind the ornamental portion thereof.

7. The jewelry display of claim 6, said display member being formed of a polymeric foam.

* * * * *